US005551606A

United States Patent [19]

Rai et al.

[11] Patent Number: 5,551,606

[45] Date of Patent: Sep. 3, 1996

[54] DISPENSER

[76] Inventors: Charn Rai, 913 Henley Street, New Westminister, B.C., Canada, V3M 4B9; Barry R. Wertz, 9022 Lyra Place, Burnaby, B.C., Canada, V3J 1B1

[21] Appl. No.: 274,973

[22] Filed: Jul. 14, 1994

[51] Int. Cl.[6] ..... B65D 88/26

[52] U.S. Cl. ..... 222/460; 141/329; 141/330; 141/364

[58] Field of Search ..... 222/81, 83, 83.5, 222/460, 527, 568; 141/329, 330, 331, 332, 337, 364, 366

[56] References Cited

U.S. PATENT DOCUMENTS

| | | | |
|---|---|---|---|
| 2,107,995 | 2/1938 | Statham et al. | 141/330 |
| 2,973,119 | 2/1961 | Parker | 222/131 |
| 3,974,942 | 8/1976 | Gray et al. | 222/83.5 |
| 4,267,945 | 5/1981 | Maynard, Jr. | 222/83.5 |
| 4,289,255 | 9/1981 | Strampe | 222/81 |
| 4,572,422 | 2/1986 | Heuberger et al. | 229/7 |
| 4,600,125 | 7/1986 | Maynard, Jr. | 222/81 |
| 5,048,691 | 9/1991 | Heuberger et al. | 206/611 |
| 5,071,035 | 12/1991 | Kiplinger | 222/83.5 |
| 5,072,762 | 12/1991 | Jimenez | 141/329 |
| 5,111,910 | 5/1992 | Sheppard, Jr. | 141/330 |
| 5,135,140 | 8/1992 | Maguire et al. | 222/521 |
| 5,141,134 | 8/1992 | Machado | 222/83.5 |
| 5,156,295 | 10/1992 | Gordon et al. | 220/416 |
| 5,161,715 | 11/1992 | Giannuzzi | 222/82 |
| 5,165,572 | 11/1992 | Bath | 222/83.5 |
| 5,201,462 | 4/1993 | Sada et al. | 229/125.15 |
| 5,203,470 | 4/1993 | Brown | 220/462 |
| 5,224,619 | 7/1993 | Dilworth et al. | 220/277 |
| 5,232,125 | 8/1993 | Adams | 222/83.5 |
| 5,280,764 | 1/1994 | Levinrad | 141/330 |
| 5,301,601 | 4/1994 | Cretors | 99/323.5 |
| 5,325,995 | 7/1994 | Harrison et al. | 222/81 |
| 5,349,995 | 9/1994 | Perez | 141/330 X |
| 5,351,859 | 10/1994 | Jansen | 222/82 |

FOREIGN PATENT DOCUMENTS

| | | | |
|---|---|---|---|
| 558401 | 11/1922 | France | 141/330 |

*Primary Examiner*—Andres Kashnikow
*Assistant Examiner*—Lisa Douglas
*Attorney, Agent, or Firm*—Darby & Darby, P.C.

[57] ABSTRACT

A funnel dispenser has a funnel portion to receive flexible pouches containing liquid products, a spike at the bottom of the funnel portion to puncture the flexible pouches and a pouring spout beneath the spike. The dispenser avoids having to cut a corner off a flexible container or pouch and hold it while it empties. The pouch sits in the dispenser and drains while being supported.

4 Claims, 2 Drawing Sheets

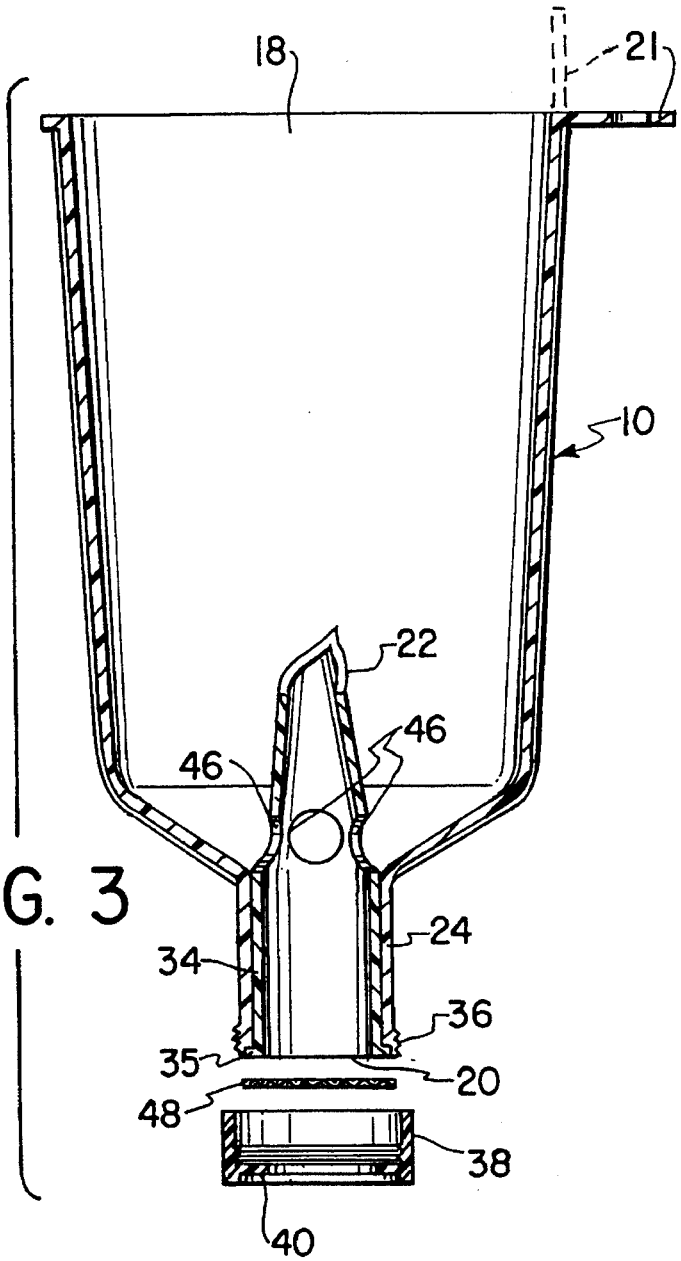
FIG. 3
FIG. 4
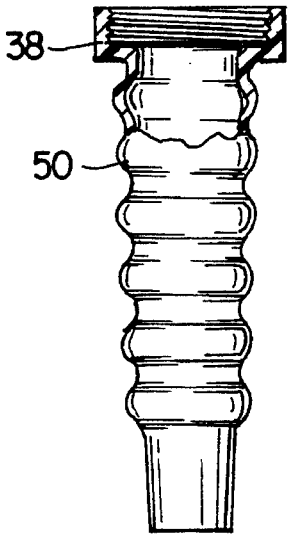
FIG. 5
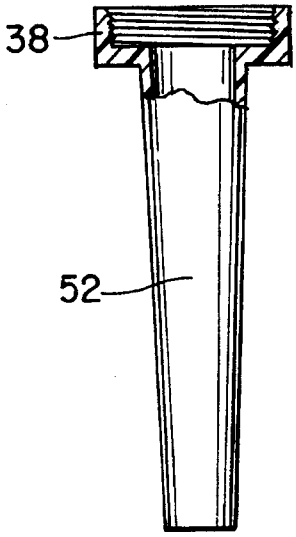

DISPENSER

TECHNICAL FIELD

This invention relates to a funnel dispenser for pouring liquids.

BACKGROUND ART

The use of flexible containers is increasingly common. In the past the so called "pillow" pouches were used which had the shape of a pillow, but nowadays what are referred to as "stand up pouches" are used. These pouches have one end which in the case of a full pouch becomes substantially circular and therefore stands up. These types of pouches are able to be displayed better than the pillow pouches. Flexible containers or pouches are seen as being environmentally acceptable where the rigid bottles and containers of the prior art are not or, at least, present difficulties in disposal. It is therefore quite common to have liquids of a wide variety packed in flexible pouches or containers. There are simple instructions printed on the container to cut off the corner or slit the corner to pour the contents from the container.

There are a number of disadvantages. The storage of liquid in an opened flexible container can be a nuisance. Typically, it is necessary to pour the unused liquid into a more rigid container. Indeed, the primary application for the flexible, stand-up pouch is for refilling liquid products into the original, rigid container. The consumer is encouraged to refill and reuse the existing, original container. This significantly reduces the plastic content, and the bulk content of garbage for disposal at municipal landfill sites.

A further disadvantage is when the flexible pouches are used for engine oil. This has not been well received at filling stations as the attendant cannot leave the flexible pouch in the engine oil inlet. Instead the attendant must stand by the vehicle. The prior art oil containers permitted the attendant to open a rigid container of oil, insert the neck into the oil inlet and leave it there while, for example, the attendants checks the tires or controls the gas pump.

There have been a number of suggestions to cure this problem. Dilworth in U.S. Pat. No. 5,224,619 teaches a container having a spike in the bottom. The idea is to place a frangible pouch within the jug. The spike pierces the pouch and the content then runs into the jug from the frangible pouch.

Gray in U.S. Pat. No. 3,974,912 teaches the holding of a pouch within a frame. Knife blades can be moved in the frame to cut the pouch. The liquid from the pouch then pours out through a funnel. As can be seen this device requires many steps to perform the end result.

Of the above devices, Dilworth et al. is believed to have the disadvantage that the frangible container being retained in the jug is potentially messy. The container must be removed at some stage. The device patented by Gray is fairly elaborate.

DISCLOSURE OF THE INVENTION

The present invention seeks to provide a dispenser with a funnel portion into which the pouch may be placed, and the act of placing, or dropping, the pouch into the funnel portion is sufficient to pierce the pouch for the contents to run out.

Accordingly, the present invention is a dispenser with a funnel portion to receive a flexible container containing a liquid, said funnel portion having an open top and an open bottom, a spike positioned adjacent said open bottom, whereby a flexible container may be placed in the funnel portion, through the open top, to be pierced by said spike to allow the liquid to escape from said flexible container and run out through the open bottom.

BRIEF DESCRIPTION OF THE DRAWINGS

The invention is illustrated in the drawings in which:

FIG. 3 illustrates a further embodiment of the present invention; and

FIG. 4 and FIG. 5 illustrate optional spout extensions for the dispenser of the present invention.

BEST MODE FOR CARRYING OUT THE INVENTION

Figure 1:
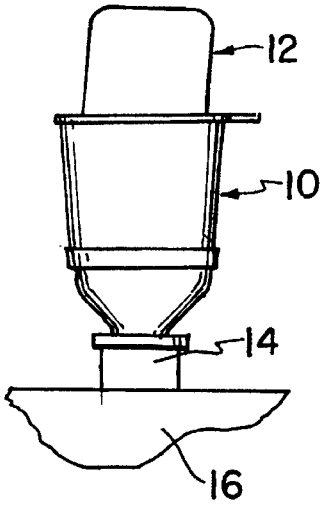
FIG. 1 illustrates the present invention in use.
Figure 2:
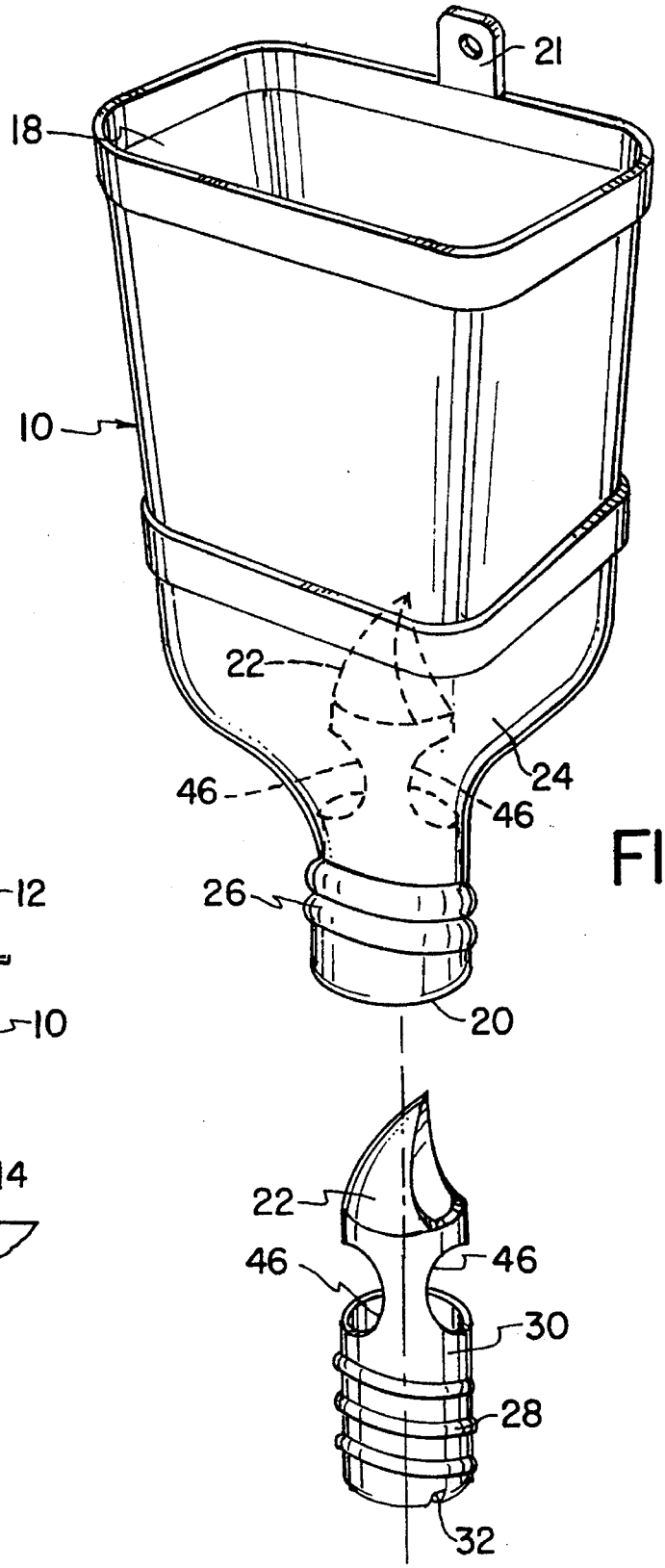
FIG. 2 is an exploded view of one embodiment of the present invention.

The drawings show a dispenser with a funnel portion 10 to receive a pouch 12 or flexible container 12 containing a liquid. The liquid is not shown but FIG. 1 illustrates such a flexible container 12 inserted in the funnel portion 10 and pouring oil into the oil inlet 14 of an internal combustion engine 16. Whereas the embodiment refers to motor oil, any type of liquid may be contained in pouches, for example, detergents, household cleaning products, consumer food products, such as cooking oil, condiments, juices, milk etc and industrial liquid products. As shown in FIGS. 2 and 3, the funnel portion 10 has an open top 18 and an open bottom 20. A hanging flap 21 is shown at one side of the top edge of the funnel portion 10. The flap 21 may be horizontal as shown in full line or vertical as shown in dotted line.

There is a spike 22 positioned adjacent the open bottom 20. In FIGS. 2 and 3, the open bottom 20 is located at the end of a substantially tubular spout 24 that extends from the main body of the funnel portion 10. In FIG. 2, the spike 22 is attached to the spout 24 by the formation of an internal thread 26 in the spout 24 and an external thread 28 on a shank 30 attached to the spike 22. The spike 22 can then be screwed into position in the spout 24, a slot 32 in the end of the shank 30 of the spike 22 facilitates the rotation of the spike 22.

In FIG. 3, the spike 22 has a shank 34 that is a sliding fit within the spout 24. The lower end of the spike 22 has a flange 35 that is retained in the end of the spout 24. Thus the spike 22 may easily be removed for cleaning. This is particularly useful for consumer food products. There is an external thread 36 on the spout 24 and a threaded ring 38 is received on the external thread 36 to hold the spike 22 in the spout 24. For that purpose, the ring 38 is provided with a shoulder 40 that abuts the flange 35 at the end of the shank 34. The shank 34 also abuts small projections 42 formed at the top of the spout 24. These projections 42 may be omitted if the flange 35 is provided on the end of the shank 34 or alternatively the flange 35 may be omitted and the projection 42 provided.

FIGS. 2 and 3 both show the spike having openings 46 so that the liquid from the pierced flexible container 12 may easily pass from the main body of the funnel portion 10, which holds the flexible container 12, out through the open bottom 20.

FIGS. 3 also shows the use of a filter member 48, for example, a small piece of gauze or filter screen, that can be trapped between the shoulder 40 of threaded ring 38 and the end of the spout 24.

FIGS. 4 and 5 show optional down spout extensions. In FIG. 4, the extension 50 is an accordion style flexible extension and in FIG. 5, the extension 52 is a rigid tapered extension. The extension 50, 52 both have a threaded ring 38 at the top for connection to the end of the spout 24.

To use the dispenser of the present invention, it is simply necessary to position the dispenser in the opening 14 to receive the fluid. In FIG. 1, the opening 14 is in an engine 16 and the liquid will be engine oil. The flexible container 12 is then dropped or placed firmly in the funnel portion 10 so that the spike 22 pierces the flexible container and the oils runs out into the engine.

The dispenser 10 and flexible container 12 may be left until all the oil is drained into the engine. It is not necessary to hold the flexible pouch as in the prior art.

The dispenser of the present invention may be made of an easily moulded plastic. Polyethylene is perfectly adequate.

The present invention thus provides a simple means of holding an opened flexible pouch. In the case of pouches containing engine oil, the private owner who does his own maintenance, or the filling station, will have one or, at most, a small number of dispensers which do not leave the premises. In the case of, for example, liquid household cleaning products, when the consumer is encouraged to refill the original, rigid container, the refilling of that container is greatly facilitated by the present invention and, of course, only one such rigid container is necessary. Flexible containers are not nearly as great a problem with, for example, landfill as rigid containers. Thus the advantages of the flexible containers are maintained.

Although the forgoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A dispenser with a funnel portion to receive a flexible plastic pouch containing a liquid, the funnel portion having an open top and an open bottom, comprising:

a spike positioned adjacent the center of the open bottom, whereby the flexible plastic pouch is placed in the funnel portion, through the open top, to be pierced by said spike to allow the liquid to escape from the flexible plastic pouch and flow out through the open bottom;

a spout wherein the open bottom is positioned at the end of said spout, and said spike has a shank that engages said spout: and an external thread on said spout and a threaded ring to be received on said external thread to hold aid spike within said spout.

2. A dispenser with a funnel portion to receive a flexible plastic pouch containing a liquid, the funnel portion having an open top and an open bottom, comprising:

a spike positioned adjacent the center of the open bottom, whereby the flexible plastic pouch is placed in the funnel portion, through the open top, to be pierced by said spike to allow the liquid to escape from the flexible plastic pouch and flow out through the open bottom wherein the funnel portion terminates in a tubular spout and said spike has a shank fitting within said spout, said shank fitting is retained in said spout by a threaded ring which engages a screw thread on the end of said spout.

3. A dispenser with a funnel portion to receive a flexible plastic pouch containing a liquid, the funnel portion having an open top and an open bottom, comprising:

a spout, the open bottom being at the end of the spout, said spout having an external thread;

a spike positioned adjacent the center of the open bottom, said spike having a shank that engages said spout; and a threaded ring to be received on said external thread to hold said spike within said spout, whereby the flexible plastic pouch is placed in the funnel portion, through the open top, to be pierced by said spike to allow the liquid to escape from said flexible plastic pouch and flow out through the open bottom of said spout.

4. A dispenser with a funnel portion to receive a flexible plastic pouch containing a liquid, the funnel portion having an open top and an open bottom, comprising:

a tubular spout attached to the funnel potion;

a spike positioned adjacent the center of the open bottom of the funnel portion; and a spike having a shank fitting within said tubular spout, said shank fitting being retained in said spout by a threaded ring which engages a screw thread on the end of said spout, whereby the flexible plastic pouch it placed in the funnel portion, through the open top, to be pierced by said spike to allow the liquid to escape from the flexible plastic pouch and flow out through the open bottom of said spout.

* * * * *